US011386855B2

(12) United States Patent
Liang et al.

(10) Patent No.: US 11,386,855 B2
(45) Date of Patent: Jul. 12, 2022

(54) VOLTAGE CONTROL CIRCUIT AND POWER SUPPLY VOLTAGE CONTROL METHOD, AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Hengzhen Liang, Beijing (CN); Xuesong Tian, Beijing (CN); Wen Xu, Beijing (CN); Xu Lu, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/269,546

(22) PCT Filed: May 20, 2020

(86) PCT No.: PCT/CN2020/091244
§ 371 (c)(1),
(2) Date: Feb. 19, 2021

(87) PCT Pub. No.: WO2020/233590
PCT Pub. Date: Nov. 26, 2020

(65) Prior Publication Data

US 2021/0287613 A1 Sep. 16, 2021

(30) Foreign Application Priority Data

May 21, 2019 (CN) ..... 201910423808.3

(51) Int. Cl.
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2300/0452* (2013.01);
(Continued)

(58) Field of Classification Search
CPC ..... G09G 3/3291; G09G 3/2003; G09G 2300/0452; G09G 2310/08; G09G 2310/027; G09G 2320/0233
See application file for complete search history.

(56) References Cited

U.S. PATENT DOCUMENTS 8,259,139 B2 9/2012 Culbert et al.
9,064,455 B2 6/2015 Kim
(Continued)

FOREIGN PATENT DOCUMENTS

CN 102867480 A 1/2013
CN 103021335 A 4/2013
(Continued)

OTHER PUBLICATIONS

First office action issued in Chinese Patent Application No. 201910423808.3 with search report.

*Primary Examiner* — Kenneth B Lee, Jr.
(74) *Attorney, Agent, or Firm* — Chiwin Law LLC

(57) ABSTRACT

A voltage control circuit is configured to connected to a display panel, the display panel includes a plurality of pixels, the plurality of pixels includes a first pixel and a second pixel, and the first pixel and the second pixel are pixels corresponding to different colors. The voltage control circuit is configured to provide a first voltage to the first pixel and a second voltage to the second pixel at a first time and a second time, respectively; the first voltage provided at the first time is different from the second voltage provided
(Continued)

at the first time, and the first voltage provided at the second time is identical with the second voltage provided at the second time.

14 Claims, 7 Drawing Sheets

(52) U.S. Cl.
CPC ... *G09G 2310/027* (2013.01); *G09G 2310/08* (2013.01); *G09G 2320/0233* (2013.01); *G09G 2320/04* (2013.01)

(56) References Cited

U.S. PATENT DOCUMENTS

| | | | |
|---|---|---|---|
| 10,553,153 | B2 | 2/2020 | Liu et al. |
| 10,783,829 | B2 | 9/2020 | Liu et al. |
| 11,056,059 | B2 | 7/2021 | Li et al. |
| 2013/0010008 | A1 | 1/2013 | Yang et al. |
| 2013/0181967 | A1* | 7/2013 | Lee ..... G09G 3/3258 345/212 |
| 2014/0368491 | A1 | 12/2014 | Azizi et al. |
| 2016/0232853 | A1 | 8/2016 | Hwang et al. |
| 2016/0260375 | A1 | 9/2016 | Ruan et al. |
| 2020/0394956 | A1 | 12/2020 | Xu et al. |

FOREIGN PATENT DOCUMENTS

| | | | |
|---|---|---|---|
| CN | 103208253 | A | 7/2013 |
| CN | 102486910 | A | 1/2016 |
| CN | 105405396 | A | 2/2016 |
| CN | 105390094 | A | 3/2016 |
| CN | 107871772 | A | 4/2018 |
| CN | 108470540 | A | 8/2018 |
| CN | 108648690 | A | 10/2018 |
| CN | 109147674 | A | 1/2019 |
| CN | 208488961 | U | 2/2019 |
| CN | 110060649 | A | 7/2019 |
| CN | 101894860 | A | 11/2020 |
| JP | 2015121799 | A | 7/2015 |

* cited by examiner

VOLTAGE CONTROL CIRCUIT AND POWER SUPPLY VOLTAGE CONTROL METHOD, AND DISPLAY DEVICE

This application is a U.S. National Phase Entry of International Application No. PCT/CN2020/091244 filed on May 20, 2020, designating the United States of America and claiming priority to Chinese Patent Application No. 201910423808.3, filed on May 21, 2019. The present application claims priority to and the benefit of the above-identified applications and the above-identified applications are incorporated by reference herein in their entirety.

TECHNICAL FIELD

Embodiments of the present disclosure relate to a voltage control circuit, a power supply voltage control method, and a display device.

BACKGROUND

With the rapid development of display technology, semiconductor element technology, which is the core of a display device, has also made rapid progress. For existing display devices, organic light-emitting diode (referred to as OLED), as a current-type light-emitting device, is widely used in the field of high-performance display technology due to its self-illumination, fast response, wide viewing angle, and can be fabricated on flexible substrates.

SUMMARY

At least one embodiment of the present disclosure provides a voltage control circuit, the voltage control circuit is configured to be connected with a display panel, the display panel includes a plurality of pixels, the plurality of pixels include a first pixel and a second pixel, and the first pixel and the second pixel are pixels corresponding to different colors. The voltage control circuit is configured to provide a first voltage to the first pixel and a second voltage to the second pixel at a first time and a second time, respectively. The first voltage provided at the first time is different from the second voltage provided at the first time are different; and the first voltage provided at the second time is identical with the second voltage provided at the second time.

In some examples, the voltage control circuit is further configured to determine whether a display image of a current frame of the display panel is a risk image, and in response to the display image of the current frame is the risk image, the first time is within the current frame.

In some examples, the voltage control circuit is further configured to: acquire a first grayscale value of the display image of the current frame of the display panel and a second grayscale value of a display image of a previous frame of the display panel; and determine whether the display image of the current frame is the risk image according to the first grayscale value and the second grayscale value.

In some examples, the plurality of pixels are divided into n display units, and the voltage control circuit is further configured to: for the n display units, calculate n differences between first grayscale value of the display image of the current frame and second grayscale value of the display image of the previous frame, respectively; and in response to a number of differences greater than a preset difference among the n differences is greater than a preset value n*k, determine the display image of the current frame as the risk image, wherein n is an integer greater than ten thousand, and $0<k\leq 1$.

In some examples, k is greater than or equal to 75%.

In some examples, the voltage control circuit is further configured to: acquire the first grayscale value of the display image of the current frame of the display panel and the second grayscale value of the display image of the previous frame of the display panel, and acquire a brightness value of the display image of the previous frame of the display panel, and determine whether the display image of the current frame is the risk image according to the first grayscale value, the second grayscale value and the brightness value.

In some examples, the voltage control circuit is further configured to: for the n display units, calculate n differences between first grayscale value of the display image of the current frame and second grayscale value of the display image of the previous frame, respectively; and in response to the brightness value of the display image of the previous frame is less than a preset brightness value and a number of differences greater than a preset difference among the n differences is greater than a preset value, determine the display image of the current frame as the risk image.

In some examples, the plurality of pixels further include a third pixel, and the first pixel, the second pixel and the third pixel are pixels corresponding to different colors, respectively. The voltage control circuit is further configured to provide a third voltage to the third pixel at the first time and the second time, respectively; the first voltage, the second voltage, and the third voltage provided at the first time respectively are all different from each other; and the first voltage, the second voltage, and the third voltage provided at the second time respectively are all identical.

In some examples, the voltage control circuit is further configured to: in response to the display image of the current frame is the risk image, provide, at the first time, the first voltage, the second voltage, and the third voltage to the first pixel, the second pixel, and the third pixel, respectively.

In some examples, the first pixel is a red pixel, the second pixel is a green pixel, and the third pixel is a blue pixel; and the first voltage provided at the first time is less than the third voltage provided at the first time, and the third voltage provided at the first time is less than the second voltage provided at the first time.

In some examples, the voltage control circuit is further configured to: in response to the display image of the current frame is the risk image, pull up the second voltage and the third voltage, and keep the first voltage unchanged.

At least one embodiment of the present disclosure provides a display device, which includes the above-mentioned voltage control circuit and the display panel. The display panel includes a first power supply voltage terminal and a second power supply voltage terminal, the first pixel is connected to the first power supply voltage terminal to receive the first voltage, and the second pixel is connected to the second power supply voltage terminal to receive the second voltage; and the voltage control circuit is respectively connected to the first power supply voltage terminal and the second power supply voltage terminal to provide the first voltage and the second voltage.

In some examples, the first pixel includes a first pixel circuit and a first light emitting element connected to the first pixel circuit, the second pixel includes a second pixel circuit and a second light emitting element connected to the second pixel circuit, and the first light emitting element and the second light emitting element are configured to emit light of different colors.

In some examples, the first pixel circuit and the second pixel circuit respectively include a driving sub-circuit, and each of the driving sub-circuit comprises a control terminal, a first terminal and a second terminal; the first terminal of the driving sub-circuit of the first pixel circuit is configured to receive the first voltage from the first power supply voltage terminal, the second terminal of the driving sub-circuit of the first pixel circuit is connected to the first light emitting element, and the driving sub-circuit of the first pixel circuit is configured to form a driving current flowing through the first light emitting element in response to the first voltage received from the first power supply voltage terminal; and the first terminal of the driving sub-circuit of the second pixel circuit is configured to receive the second voltage from the second power supply voltage terminal, the second terminal of the driving sub-circuit of the second pixel circuit is connected to the second light emitting element, and the driving sub-circuit of the second pixel circuit is configured to form a driving current flowing through the second light emitting element in response to the second voltage received from the second power supply voltage terminal.

In some examples, the display device further includes a first power supply line and a second power supply line, the first power supply line electrically connects the first power supply voltage terminal with the first terminal of the driving sub-circuit of the first pixel circuit, and the second power supply line electrically connects the second power supply voltage terminal with the first terminal of the driving sub-circuit of the second pixel circuit; and the first power supply line is insulated from the second power supply line.

At least one embodiment of the present disclosure provides a power supply voltage control method for providing a power supply voltage for a display panel, the display panel includes a plurality of pixels, the plurality of pixels include a first pixel and a second pixel, the first pixel and the second pixel are pixels corresponding to different colors, and the method includes: providing a first voltage to the first pixel and a second voltage to the second pixel at a first time and a second time, respectively, in which the first voltage provided at the first time is different from the second voltage provided at the first time are different, and the first voltage provided at the second time is identical with the second voltage provided at the second time.

In some examples, the method further includes: determining whether a display image of a current frame of the display panel is a risk image, in which in response to the display image of the current frame is the risk image, the first time is within the current frame.

In some examples, determining whether the display image of the current frame of the display panel is the risk image includes: acquiring a first grayscale value of the display image of the current frame of the display panel and a second grayscale value of a display image of a previous frame of the display panel; and determining whether the display image of the current frame is the risk image according to the first grayscale value and the second grayscale value.

In some examples, the plurality of pixels are divided into n display units, and determining whether the display image of the current frame is the risk image according to the first grayscale value and the second grayscale value includes: for the n display units, calculating n differences between first grayscale value of the display image of the current frame and second grayscale value of the display image of the previous frame, respectively; and in response to a number of differences greater than a preset difference among the n differences is greater than a preset value n*k, determining the display image of the current frame as the risk image, wherein n is an integer greater than ten thousand, and $0<k\leq 1$.

In some examples, k is greater than or equal to 75%.

BRIEF DESCRIPTION OF THE DRAWINGS

In order to explain the technical solutions of the embodiments of the present disclosure more clearly, the accompanying drawings of the embodiments will be briefly introduced below. Obviously, the accompanying drawings in the following description only relate to some embodiments of the present disclosure, rather than the limitation of the invention.

DETAILED DESCRIPTION

In order to make objects, technical solutions and advantages of the embodiments of the disclosure apparent, the technical solutions of the embodiments will be described clearly and completely in combination with the drawings related to the embodiments of the disclosure. Apparently, the described embodiments are part of the embodiments of the disclosure, rather than all of the embodiments. Based on the described embodiments herein, all other embodiments obtained by those skilled in the art without creative labor are within the protection scope of the present disclosure.

Unless otherwise defined, all the technical and scientific terms used herein shall have the usual meanings understood by those with ordinary skills in the field to which the present disclosure belongs. The terms "first", "second" and similar words used in the present disclosure are not intended to indicate any sequence, amount or importance, but are only used to distinguish various components. Also, the terms such as "a", "one" or "the" are not intended to limit the amount, but indicate the existence of at least one. The terms "comprise" or "include" are intended to specify that the elements or the objects stated before these terms encompass the elements or the objects and equivalents thereof listed after these terms, without excluding other elements or objects. The phrases "connect", "connected to", etc., are not limited to physical or mechanical connections, but may include electrical connections, directly or indirectly. The terms of "up", "down", "left" or "right" and the like are only used to indicate relative position relationship, and when the absolute position of the described object changes, the relative position relationship may also change accordingly.

The inventor found that in existing OLED products, due to the electrical characteristics of electro-luminescent (EL) materials, EL materials of different colors (such as EL material of red (R), EL material of green (G), EL material of blue (B)) have different startup threshold voltages and different response speeds to startup currents, which leads to a reduction in the quality of the display image. For example, in the case where dragging the display image (such as a static display image) or the refresh frequency of the display image is high (such as higher than 120 Hz), when the display image (such as a partial image) changes from low grayscale to high grayscale and the gray level difference of display image of adjacent frames (such as a partial image) is too large (for example, more than 20 gray levels), the residual mixed color shadowing phenomenon will appear at the edge of the light and dark junction of the image, which reduces the display quality. For example, the above-mentioned phenomenon is particularly obvious when the brightness of the display image of a previous frame is low (for example, less than 50 nits).

Figure 1:
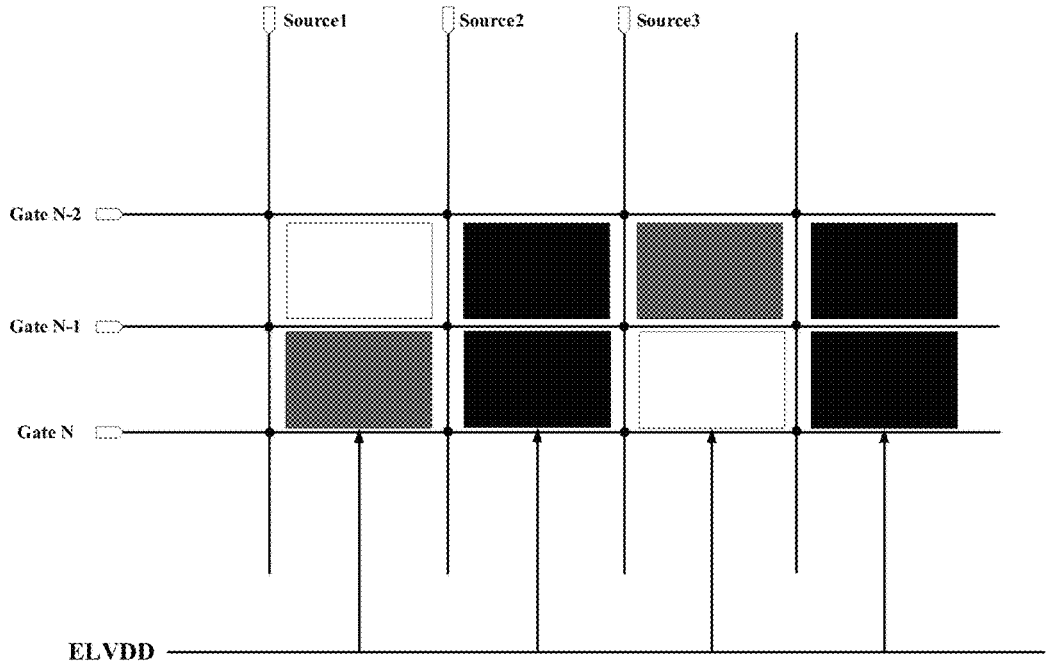
FIG. 1 is a schematic structural diagram of a driving circuit of a pixel array.
Figure 2:
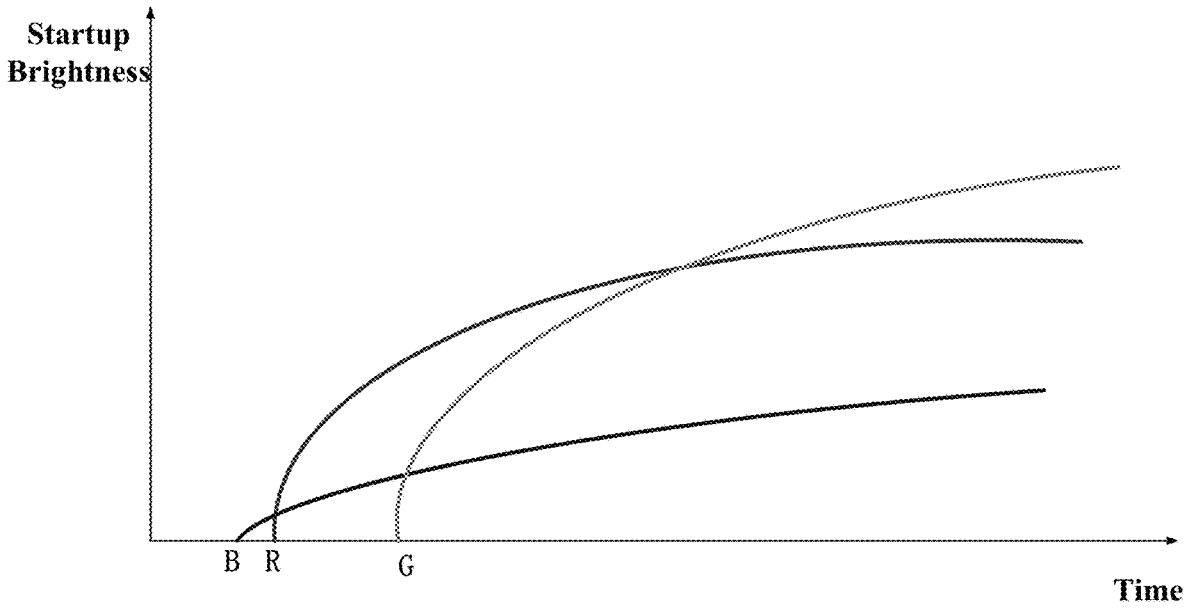
FIG. 2 is a startup brightness-time curve diagram of an RGB pixel.
Figure 3:
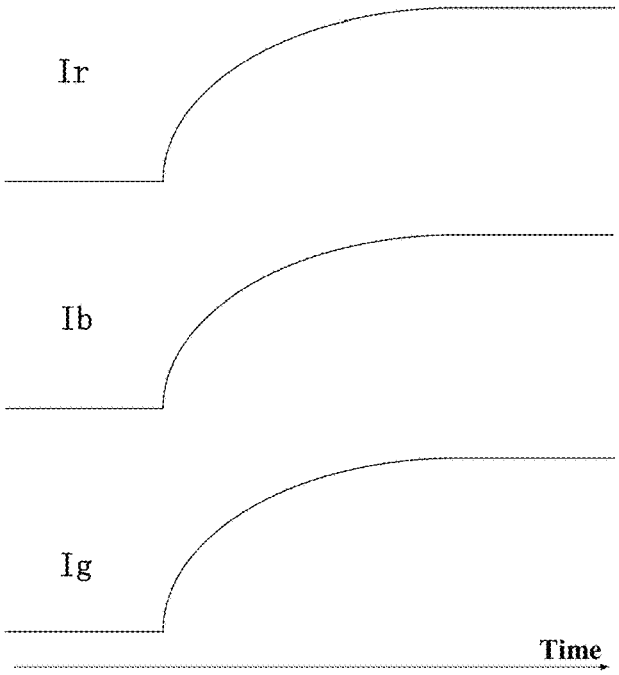
FIG. 3 is a startup current-time curve diagram of an RGB pixel.

Generally, in the field of display technology, when driving a pixel array, all pixels (such as R, G, and B pixels) are generally driven by the same driving voltage ELVDD, as shown in FIG. 1. For example, pixels corresponding to different colors in the same row are all connected to the same power line ELVDD to receive the same driving voltage ELVDD. Under the driving of the driving voltage ELVDD, an example of startup brightness-time curve and an example of startup current-time curve are shown in FIG. 2 and FIG. 3, respectively.

When switching the display images, for example, switching from a display image with low grayscale to a display image with high grayscale, each pixel undergoes a startup lighting stage before reaching a stable brightness and achieving a stable display image, for example, the duration of the startup lighting stage is several frames (for example, 4 frames). For example, it can be seen from FIG. 2 and FIG. 3 that in the startup lighting stage, the EL materials of red (R), green (G) and blue (B) have different response time (startup time) and response speed to the startup current. The EL material of blue emits light first but have the slowest increase in brightness, the EL material of red emits light fast and the brightness increases faster, and the EL material of green emits light the latest but have the fastest increase in brightness. Although the current flowing through the EL materials of different colors are the same, the change speeds of the brightness caused by the current in the EL materials of different colors are different, which leads to the smear phenomenon in the startup lighting stage before reaching an image stabilization stage. In this case, after the pixels in the pixel array are charged, a trigger signal is turned on at the same time, and the current response characteristics of each EL material cannot be controlled independently. In the case where the brightness is low, the difference in the startup speed of the R, B, and G pixels may cause the mixed color smear phenomenon at the edge of the light and dark junction of the image, and the image quality is reduced. To this end, the present disclosure provides a voltage control circuit, a power supply voltage control method, and a display device.

The embodiments of the present disclosure are described in detail below. Examples of the embodiments are shown in the accompanying drawings, in which the same or similar reference numerals indicate the same or similar elements or elements with the same or similar functions. The embodiments described below with reference to the accompanying drawings are exemplary, and are intended to explain the present disclosure, but should not be construed as limitations of the present disclosure.

Next, the voltage control circuit, the power supply voltage control method, and the display device provided by the embodiments of the present disclosure will be described with reference to the accompanying drawings.

Figure 4A:
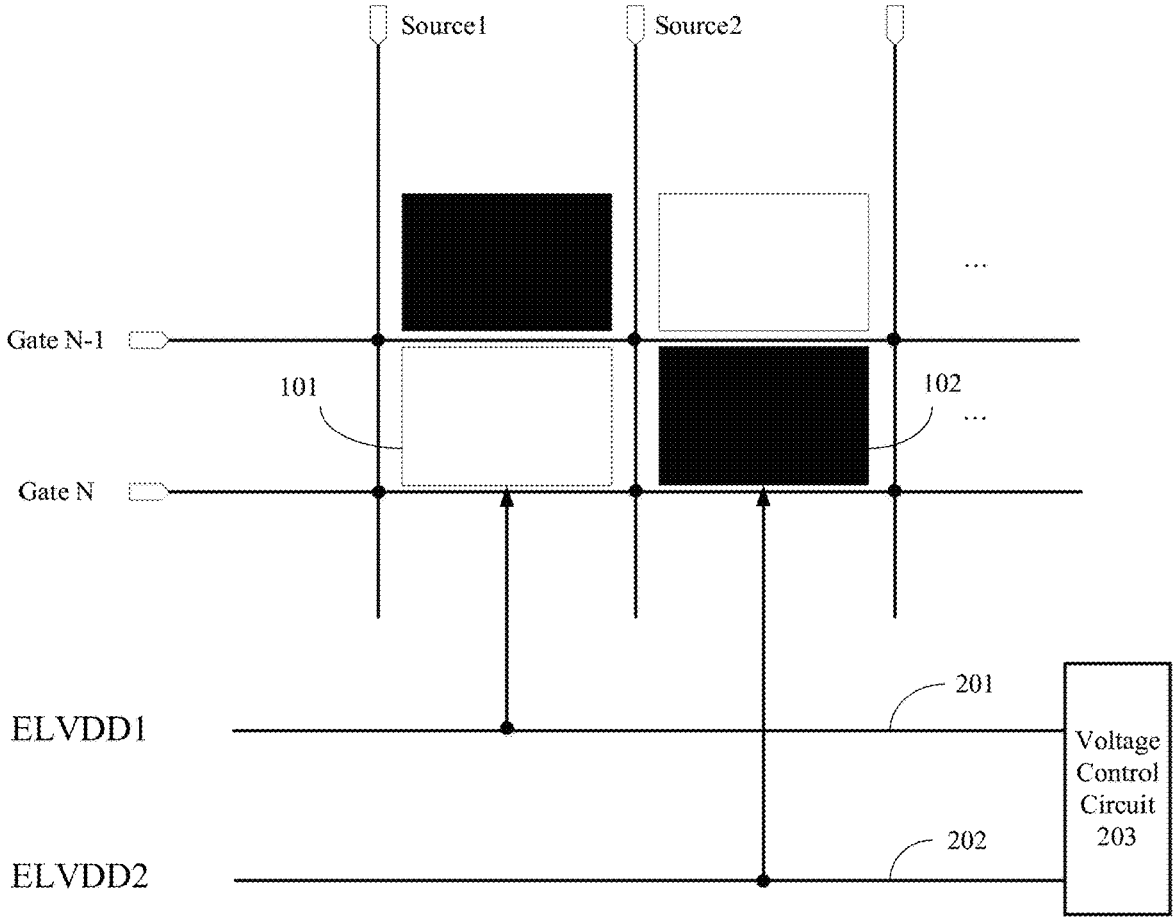
FIG. 4A is a schematic structural diagram of a voltage control circuit provided by an embodiment of the present disclosure.
Figure 4B:
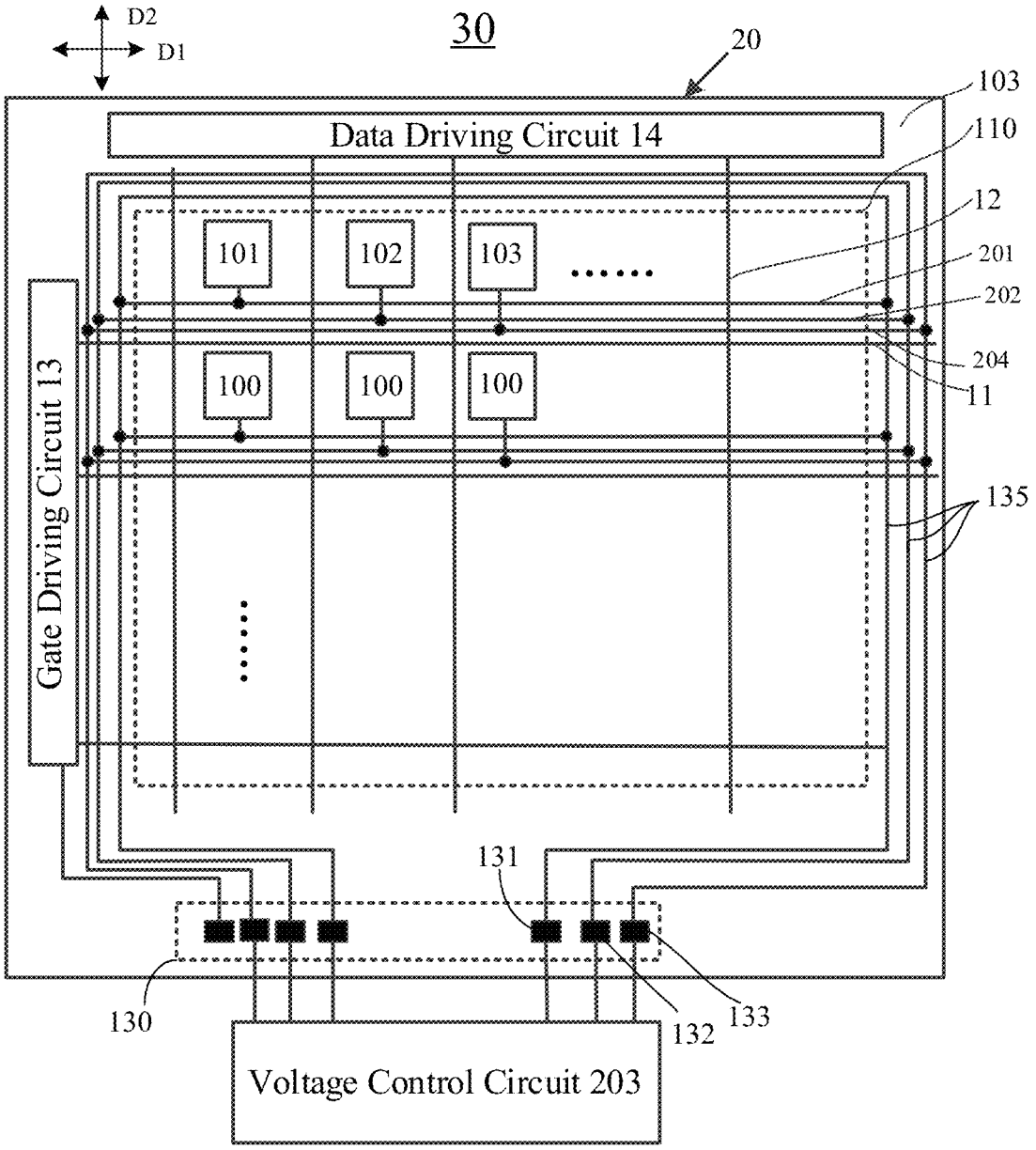
FIG. 4B is a schematic structural diagram of a display device provided by at least one embodiment of the present disclosure.

FIG. 4A is a schematic structural diagram of a voltage control circuit according to an embodiment of the present disclosure, and FIG. 4B is a schematic structural diagram of a display device provided by an embodiment of the present disclosure.

As shown in FIG. 4A and FIG. 4B, the voltage control circuit 203 is used for connecting the display panel 20 to provide the power supply voltage ELVDD. The display panel includes a plurality of pixels 100, and the plurality of pixels includes red pixels, green pixels, and blue pixels.

The plurality of pixels includes a first pixel 101 and a second pixel 102, and the first pixel 101 and the second pixel 102 are pixels corresponding to different colors. The voltage control circuit 203 is configured to provide a first voltage ELVDD1 to the first pixel 101 and a second voltage ELVDD2 to the second pixel 102 at a first time t1 and a second time t2, respectively; the first voltage provided at the first time t1 is different from the second voltage provided at the first time t1; and the first voltage provided at the second time t2 is identical with the second voltage provided at the second time t2. For example, the first pixel 101 may correspond to red pixels, and the second pixel 102 may correspond to green pixels or blue pixels.

Considering that the EL materials of the first pixel and the second pixel have different response characteristics to current during the startup lighting stage, the voltage control circuit 203 outputs different power supply voltages to the first pixel and the second pixel during the startup lighting stage to reduce the difference in the startup lighting speed of the first pixel and the second pixel, that is, reduce the difference in brightness change per unit time under the same current, thereby alleviating the smear phenomenon (that is the shadowing in the display image). For example, the first voltage and the second voltage in the startup lighting stage can be adjusted according to the response characteristics of the EL materials of different colors to the startup current shown in FIG. 2. This will be described in detail later.

As shown in FIG. 4B, the display device 30 includes a display panel 20 and the voltage control circuit 203, and the voltage control circuit 203 is electrically connected to the display panel 20 to provide the power supply voltage ELVDD for the pixel circuit.

As shown in FIG. 4B, the display panel 20 includes a display region 110 and a non-display region 103 outside the display region 110. For example, the non-display region 103 is located in a peripheral region of the display region 110. The display panel 20 includes a plurality of pixels 100 located in the display region 110. For example, the plurality of pixels are arranged in an array along a first direction D1 and a second direction D2, and the first direction D1 and the second direction D2 are different, for example, the two are orthogonal. For example, sub-pixels can form pixel units in a traditional RGB manner or a manner of sub-pixel sharing (for example, pentile) to realize full-color display. The present disclosure does not limit the arrangement of the sub-pixels and the manner of realizing full-color display.

The display panel 20 further includes a plurality of scan lines 11 and a plurality of data lines 12 located in the display region 110, and the plurality of scan lines 11 and the plurality of data lines 12 cross each other to define a plurality of pixel regions in the display region 110, and one pixel 100 is correspondingly arranged in each pixel region. For example, the scan lines 11 extend along the first direction D1, and the data lines 12 extend along the second direction D2.

Each pixel 100 includes a pixel circuit and a light emitting element, and the pixel circuit is used to drive the light emitting element to emit light. The pixel circuit is, for example, a conventional pixel circuit, such as a 2T1C (that is, including two transistors and one capacitor) pixel circuit, 4T2C, 5T1C, 7T1C, and other nTmC (n, m are positive integers) pixel circuits, and in different embodiments, the pixel circuit may further include a compensation sub-circuit. The compensation sub-circuit includes an internal compensation sub-circuit or an external compensation sub-circuit, and the compensation sub-circuit may include transistors, capacitors, and the like. For another example, the pixel circuit may further include a reset circuit, a light emitting control sub-circuit, a detection circuit, etc., as required. For example, the light emitting element is an organic light-emitting diode (OLED).

For example, the display panel 20 may further include a gate driving circuit 13 and a data driving circuit 14 located in the non-display region 103. For example, the gate driving circuit 13 can be connected to the pixel circuit through the scan lines 11 to provide various scan signals or control signals for the pixels; and the data driving circuit 14 may be connected to the pixel circuit through the data lines 12 to provide data signals.

For example, the display panel 20 further includes a plurality of power supply lines to provide power supply voltages for the pixel circuit of each pixel. As shown in FIG. 4B, the display panel 20 includes a first power supply line 201 and the second power supply line 202, the first power supply line 201 is connected to the first pixel 101 to provide the first voltage ELVDD1 for the first pixel 101, and the second power supply line 202 is connected to the second pixel 102 to provide the second voltage ELVDD2 for the second pixel 102. For example, the first power supply line 201 and the second power supply line 202 both extend along the first direction D1 and are insulated from each other.

For example, the non-display region 103 is provided with a bonding area 130, and the bonding area is provided with a plurality of bonding electrodes or signal terminals. The bonding electrodes are connected to the circuit (such as the gate driving circuit 13) or power supply lines in a display substrate 20 through wirings and used to bond with an external circuit (such as an IC chip), so as to provide electrical signals (such as clock signals, power supply voltage signals, etc.) for the circuits or signal lines in the display substrate. For example, as shown in FIG. 4B, the first power supply line 201 and the second power supply line 202 are respectively electrically connected to the first power supply voltage terminal 131 and the second power supply voltage terminal 132 in the bonding area 130 through the wiring 135 in the non-display region 103. For example, the wiring 135 is ring-shaped e and is arranged around the display region 110.

For example, the voltage control circuit 203 is connected to the display panel 20 by means of bonding. For example, the voltage control circuit 203 is mounted on a flexible circuit board (FPC, not shown), and is bonded to the display panel 20 through the flexible circuit board. In other examples, the voltage control circuit 203 may also be directly integrated in the display panel 20. The embodiments of the present disclosure do not limit the connection manner of the voltage control circuit 203 and the display panel 20.

For example, the display panel 20 may further include a control circuit (not shown). For example, the control circuit is configured to control the data driving circuit 14 to apply data signals, and control the gate driving circuit 13 to apply scan signals or control signals. An example of the control circuit is a timing control circuit (T-con). The control circuit may be in various forms, for example, including a processor and a memory. The memory includes executable codes, and the processor can run the executable codes to execute the power supply voltage control method described in the present disclosure.

For example, the processor may be a central processing unit (CPU) or another form of processing device with data processing capability and/or instruction execution capability, for example, may include a microprocessor, a programmable logic controller (PLC), etc.

For example, a storage device may include one or more computer program products, and the computer program products may include various forms of computer-readable storage medium, such as a volatile memory and/or a non-volatile memory. For example, the volatile memory may include a random-access memory (RAM) and/or a cache. The non-volatile memory may include, for example, a read-only memory (ROM), a hard disk, a flash memory, etc. One or more computer program instructions can be stored on the computer-readable storage medium, and the processor can run the computer program instructions to complete the desired function. Various application programs and various data can further be stored in the computer-readable storage medium.

The voltage control circuit sets different power supply lines for the first pixel and the second pixel and applies the first voltage and the second voltage to each power supply line respectively to control the current characteristics of the first pixel and the second pixel differently, therefore, the quality of the display image is improved and the shadowing problem caused by different startup lighting characteristics of the EL materials can be solved.

In the embodiments of the present disclosure, the voltage control circuit 203 is configured to determine whether the display image of the current frame of the display panel is a risk image; and in response to the display image of the current frame is the risk image, the first time t1 is within the current frame.

For example, before displaying the display image of the current frame, the voltage control circuit analyzes the display data of the display image of the current frame and determines whether the display image of the current frame is at risk of the above-mentioned display shadowing and other problems, and then adjusts the output first voltage and/or the second voltage in response to the display image of the current frame is determined as the risk image, so as to reduce the difference in the startup lighting speed of the first pixel 101 and the second pixel 102.

For example, the voltage control circuit 203 is configured to acquire a first grayscale value of the display image of the current frame of the display panel and a second grayscale value of a display image of a previous frame of the display panel; and determine whether the display image of the current frame is the risk image according to the first grayscale value and the second grayscale value.

For example, the plurality of pixels can be divided into a plurality of display units (for example, n display units which are denoted as D1~Dn), and the voltage control circuit 203 is configured to calculate, for the n display units, n differences between first grayscale values GL1, of the display image of the current frame and second grayscale values GL2 of the display image of the previous frame, respectively; and in response to a number of differences greater than a preset difference among the n differences is greater than a first preset value, determine the display image of the current frame as the risk image.

For example, the display image corresponding to the pixel array is analyzed and processed at first. The current frame refers to P2, and the previous frame refers to P1, the display image is divided into units, and the plurality of pixels are divided into n display units. For example, each display unit includes 25 (5*5) pixels or 100 (10*10) pixels, and the n display units are respectively denoted as D1~Dn. For each of the n display units, the first grayscale value GL1 at P1 and the second grayscale value GL2 at P2 are acquired, respectively, and the difference (GL2−GL1) of the grayscale values of the corresponding one display unit acquired at P1 and P2 are calculated, respectively. That is, a difference between the grayscale value of display unit D1 at P1 and the grayscale value of display unit D1 at P2, a difference between the grayscale value of display unit D2 at P1 and the grayscale value of display unit D2 at P2, . . . , and a difference between the grayscale value of display unit Dn at P1 and the grayscale value of display unit Dn at P2 are calculated respectively, thus a total number of n differences are calculated. Whether a number of differences greater than a preset grayscale difference (for example, as the maximum grayscale is 255, the preset grayscale difference may be 20) among the n differences is greater than a preset value n*k (that is, the grayscale difference of the display image changes greatly) is determined. If it is determined that the number of differences greater than the preset grayscale difference is greater than the preset value, it indicates that the proportion of the display units with the large grayscale differences is too large, which has a greater impact on the quality of the display image, that is, P2 is determined as the risk image. Under this case, the first voltage ELVDD1 and/or the second voltage ELVDD2 need to be adjusted. For example, according to the EL material characteristics of the first pixel 101 and the second pixel 102, during the display stage, the voltage of the first voltage ELVDD1 or the second voltage ELVDD2 in different sub-pixels is pulled up, so as to realize Over Drive (that is, speed-increasing drive) of the driving current of each pixel, thereby reducing the difference between the startup lighting time and the startup lighting brightness of the first pixel 101 and the second the pixel 102, that is, making the first pixel 101 and the second pixel 102 quickly reach the same brightness level. For example, n is an integer greater than ten thousand. For example, n is an integer in a range of 5 ten thousand to 30 ten thousand. For another example, n is an integer in a range of 10 ten thousand to 18 ten thousand. For example, k is a constant greater than 0 and less than or equal to 1, and its value can be set as required, for example, k is greater than or equal to 75%.

In some other examples, other than acquiring the first grayscale value of the display image of the current frame of the display panel and the second grayscale value of the display image of the previous frame of the display panel, the voltage control circuit 203 is also configured to acquire a brightness value of the display image of the previous frame of the display panel, and determine whether the display image of the current frame is the risk image according to the first grayscale value, the second grayscale value and the brightness value.

For example, the voltage control circuit 203 is configured to calculate, for the plurality of display units respectively, the differences between the first grayscale values of the display image of the current frame and the second grayscale values of the display image of the previous frame, and in response to the brightness value of the display image of the previous frame is less than a preset brightness value and a number of differences greater than the preset difference among the n differences is greater than the preset value, determine the display image of the current frame as the risk image. For example, the preset brightness value is 50 nits.

Figure 5:
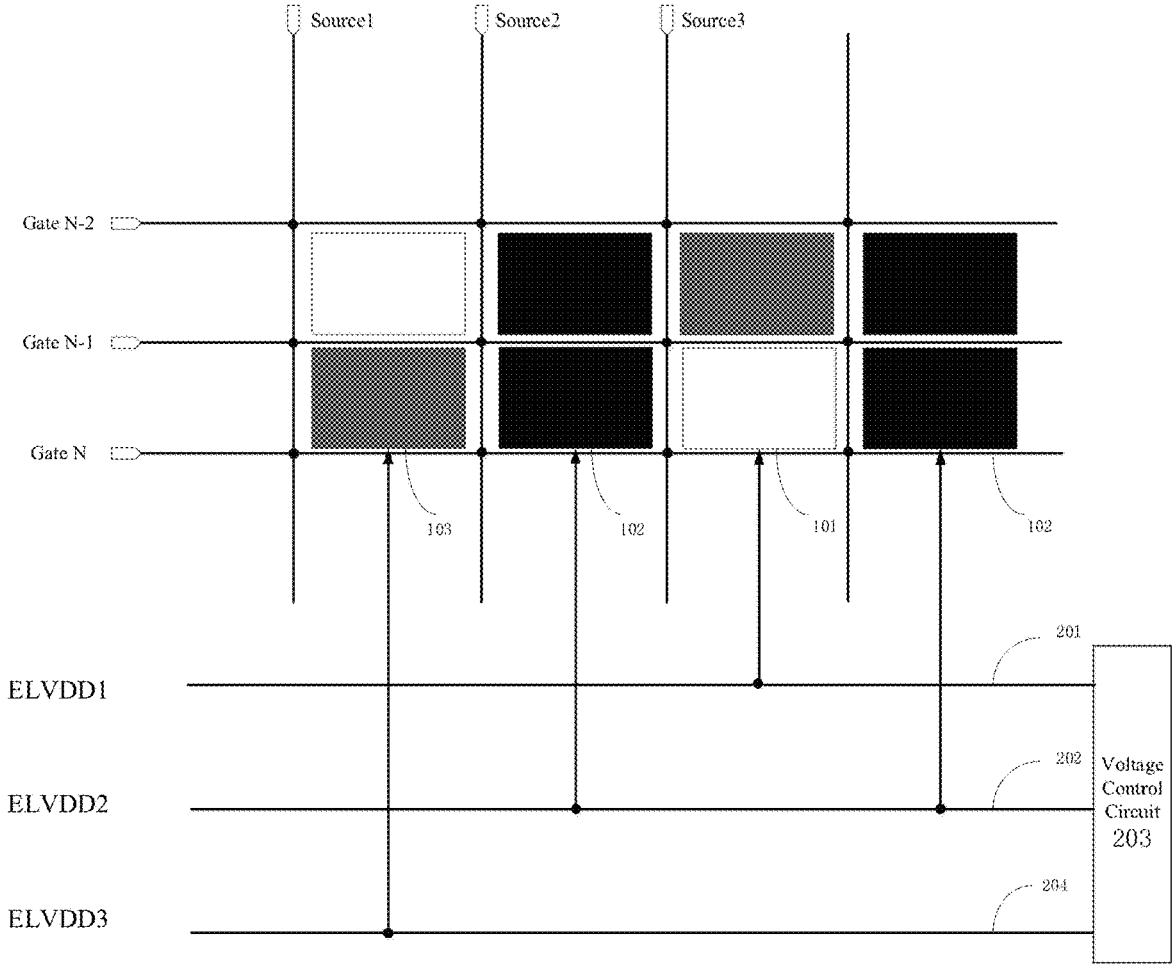
FIG. 5 is a schematic structural diagram of a voltage control circuit provided by another embodiment of the present disclosure.

The difference between the present example and the previous example is that when determining whether the current image is the risk image, the brightness of the display image of the previous frame is also considered. Because the shadowing phenomenon is more obvious in the case where the brightness of the display image of the previous frame is low, in the present example, by considering the brightness of the display image of the previous frame in determining the risk of the display image of the current frame, the efficiency and effect of the voltage control circuit on the display image are improved. In at least one embodiment of the present disclosure, as shown in FIG. 5 and FIG. 4B, the plurality of sub-pixels may further include a third pixel 103, and the first pixel 101, the second pixel 102, and the third pixel 103 are pixels corresponding to different colors. The voltage control circuit 203 is further configured to provide a third voltage ELVDD3 to the third pixel at the first time and the second time, respectively. The display panel 20 may further include a third power supply line 204, and the third power supply line 204 is used to connect a third power supply voltage terminal 133 to the third pixel 103 to provide the third voltage ELVDD3 for the third pixel 103.

In the present embodiment, as shown in FIG. 5, the voltage control circuit 203 is also connected to the third power supply line 204 to output the third voltage ELVDD3 to the third power supply line 204. The voltage control circuit 203 can adjust at least one of the first voltage ELVDD1, the second voltage ELVDD2, or the third voltage ELVDD3 when determining that the display image of the current frame is the risk image, so as to reduce the difference in the startup lighting speed of first pixel 101, the second pixel 102 and the third pixel 103.

For example, the first voltage, the second voltage and the third voltage provided at the first time are different from each other; and the first voltage, the second voltage and the third voltage provided at the second time are all identical.

For example, the first pixel 101 may be a pixel corresponding to red, the second pixel 102 may be a pixel corresponding to green, and the third pixel 103 may be a pixel corresponding to blue.

Figure 6:
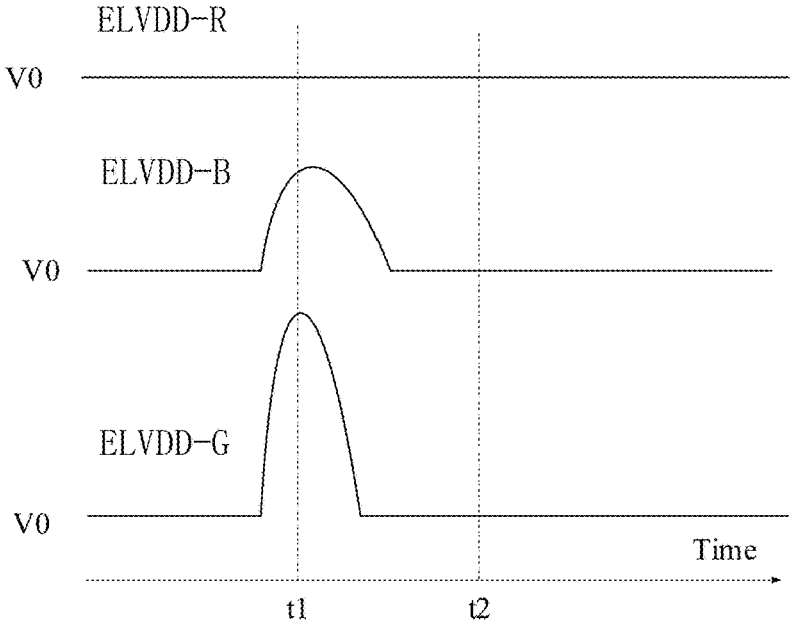
FIG. 6 is an exemplary curve diagram of driving voltages of pixels according to the present disclosure.

FIG. 6 shows a schematic diagram of waveforms of the first voltage, the second voltage, and the third voltage output by a voltage control circuit provided by at least one embodiment of the present disclosure. As shown in FIG. 6, at the first time t1, the power supply voltage ELVDD (ELVDD-R, ELVDD-B, ELVDD-G) received by the three color pixels are all different from each other; at the second time t2, the power supply voltage ELVDD received by the three color pixels are all identical, which are equal to reference voltage V0.

For example, the first time t1 is within the startup lighting stage of the display panel, and the second time t2 is within a stabilization stage after the startup lighting stage. In the startup lighting stage, the voltage control circuit reduces the difference in the startup lighting speed of the first pixel, the second pixel and the third pixel by providing power supply voltages to the first pixel, the second pixel, and the third pixel, individually. That is, the difference in brightness change per unit time under the same current is reduced, thereby alleviating the shadowing phenomenon. For example, in the stabilization stage, the first voltage and the second voltage are both the reference voltage V0.

For example, referring to FIG. 6 on the basis of the brightness characteristic curve shown in FIG. 2, when the pixel array is driven to emit light, the first voltage ELVDD1 may be less than the third voltage ELVDD3, and the third voltage ELVDD3 may be less than the second voltage ELVDD2. For ease of understanding, the working principle of the voltage control circuit of the embodiments of the present disclosure is described below based on the example shown in FIG. 5 in conjunction with FIG. 6-FIG. 9.

For example, the pixel circuit of each pixel includes a driving sub-circuit, each of the driving sub-circuit includes a control terminal, a first terminal, and a second terminal, and the driving sub-circuit is configured to form a current flowing through a light emitting element in response to a power supply voltage received from a power supply voltage terminal.

For example, the first pixel includes a first pixel circuit and a first light emitting element, and the second pixel includes a second pixel circuit and a second light emitting element. The first terminal of the driving sub-circuit of the first pixel circuit is configured to receive the first voltage from the first power supply voltage terminal 131, the second terminal of the driving sub-circuit of the first pixel circuit is connected to the first light emitting element, and the driving sub-circuit of the first pixel circuit is configured to form a driving current flowing through the first light emitting element in response to the first voltage ELVDD1 received from the first power supply voltage terminal 131. The first terminal of the driving sub-circuit of the second pixel circuit is configured to receive the second voltage from the second power supply voltage terminal 132, the second terminal of the driving sub-circuit of the second pixel circuit is connected to the second light emitting element, and the driving sub-circuit of the second pixel circuit is configured to form a driving current flowing through the second light emitting element in response to the second voltage ELVDD2 received from the second power supply voltage terminal 132.

For example, the driving sub-circuit includes a driving transistor, and a gate electrode, a first electrode, and a second electrode of the driving transistor are respectively used as the control terminal, the first terminal and the second terminal of the driving sub-circuit. For example, the driving transistor may be a thin film transistor or a field effect transistor or other switching device with the same characteristics. The source electrode and the drain electrode of the transistor used here can be symmetrical in structure, therefore, the source electrode and the drain electrode can be structurally indistinguishable. In the embodiments of the present disclosure, in order to distinguish the two electrodes of the transistor other than the gate electrode, one electrode is directly described as the first electrode and the other electrode is the second electrode.

For example, the driving transistor may be electrically connected to the power supply voltage terminal directly, or may be electrically connected to the power supply voltage terminal through a first light emitting control transistor; and the driving transistor may be electrically connected to the light emitting element directly, or may be electrically connected to the light emitting element through a second light emitting control transistor. The following descriptions take the case where the first terminal and the second terminal of the driving transistor are directly electrically connected to the power supply voltage terminal and the light emitting element as an example.

Figure 7:
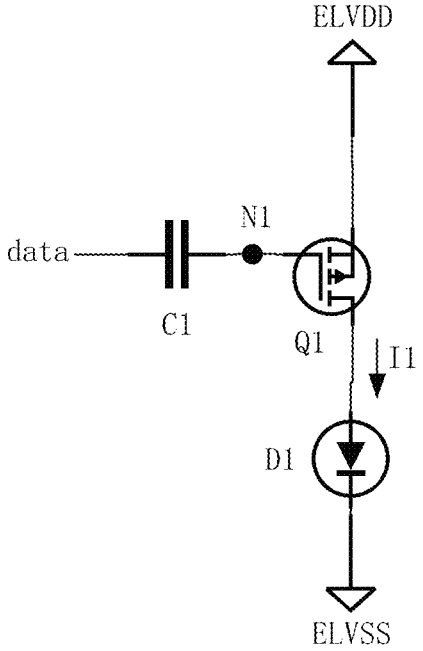
FIG. 7 is a schematic structural diagram of an exemplary basic pixel architecture according to the present disclosure.

The basic pixel structure shown in FIG. 7 includes a driving transistor Q1, a storage capacitor Ci and a light emitting element D1. The opening degree of the channel of the driving transistor Q1 controls the current I1 flowing through the light-emitting diode D1, and the voltage difference between the driving voltage ELVDD and the voltage of the N1 node (the gate electrode of the driving transistor) can control the opening degree of the channel of the driving transistor Q1. Under the premise of ensuring the normal display pixel voltage at the N1 node remains unchanged, the current flowing through D1 can be instantaneously changed by pulling up the ELVDD at the moment of channel opening (that is, the startup lighting stage), thus, the startup brightness of the sub-pixels of different colors can be controlled, while not affecting the display brightness in the stabilization stage.

Figure 8:
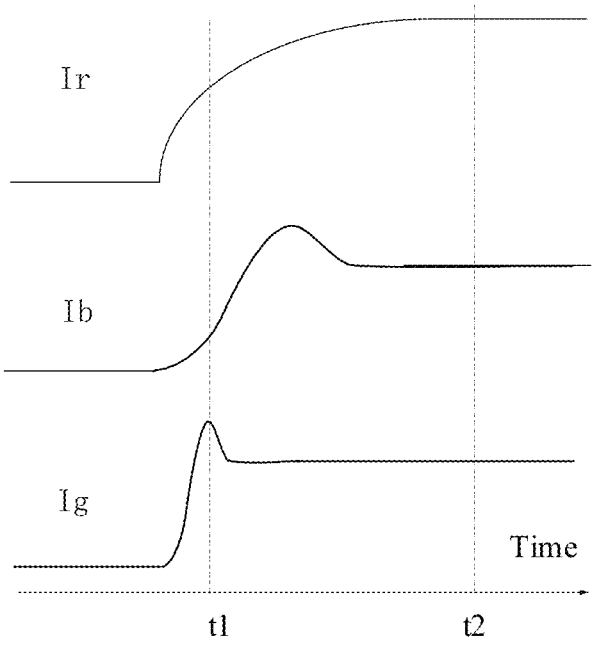
FIG. 8 is an exemplary startup current-time curve diagram of an RGB pixel according to the present disclosure.
Figure 9:
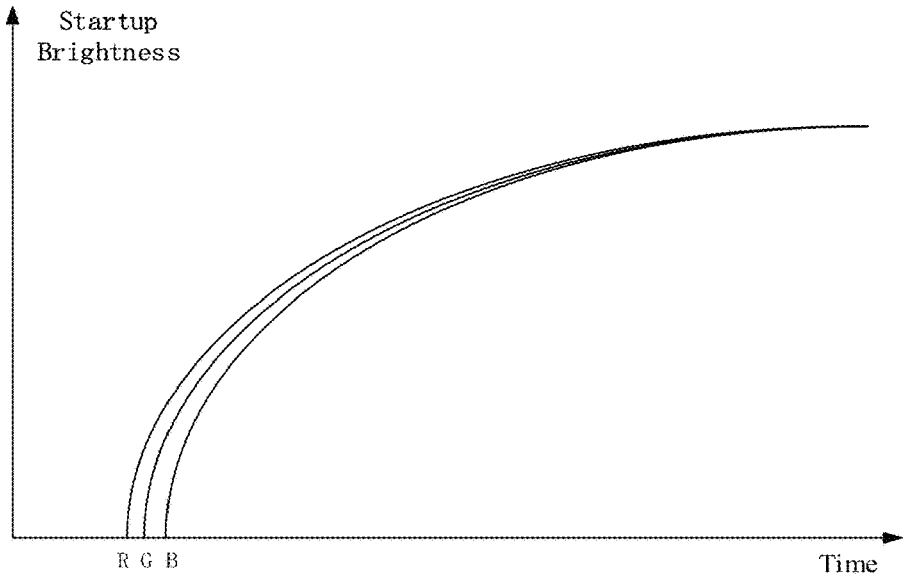
FIG. 9 is an exemplary startup brightness-time curve diagram of an RGB pixel according to the present disclosure.

For example, from the brightness characteristic curve shown in FIG. 2, it can be seen that although the blue pixel will light up fast, the brightness will be very low, while the green pixel will light up very late, but the brightness will rise quickly, and only the red pixel will light up fast and the brightness is high, so there will be red shadow. For example, because red is visually brighter and more obtrusive than green or blue, based on this, the startup lighting time of the green pixel and the startup lighting time of the blue pixel can be pulled to be faster for compensating, and the startup lighting time of the red pixel remains unchanged. As shown in FIG. 6, during the startup lighting stage, the second voltage and the third voltage are pulled up, and the first voltage remains at the reference voltage V0. In this case, corresponding to the driving voltages shown in FIG. 6, the startup current-time curve corresponding to each pixel is shown in FIG. 8, and the startup brightness-time curve is shown in FIG. 9. It can be seen from FIG. 8 and FIG. 9 that by pulling up the second voltage and the third voltage, the currents flowing through the green light emitting element and the blue light emitting element are increased, and the differences in the brightness of the three colors of pixels in the startup lighting stage are reduced, thereby effectively reducing the shadowing phenomenon.

As shown in FIG. 6 and FIG. 9, each pixel undergoes the above-mentioned startup lighting stage, and reaches its respective stable light emitting brightness at a similar startup lighting speed, and the display image enters the stabilization stage. At this time, the second voltage and the third voltage return back to the reference voltage V0, and the light emitting current and brightness of each pixel are determined by the data voltage written at the gate electrode N1 of the driving transistor, and the image distortion is prevented by the different power supply voltages ELVDD for different sub-pixels.

Of course, the adjustment countermeasures for each power supply voltage can be set according to the device characteristics of the OLED, and are not limited to the device characteristics mentioned above.

In summary, in the voltage control circuit of the embodiments of the present disclosure, for different pixels in different pixel arrays, different power supply lines can be set to apply different driving voltages respectively to control the current characteristics of each pixel individually, thereby reducing the differences between the startup lighting time and the startup lighting brightness of each pixel, improving the quality of the display image, and solving the shadowing problem caused by the different startup lighting characteristics of the EL materials.

Figure 10:
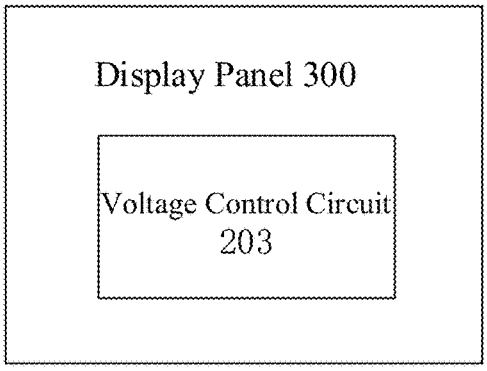
FIG. 10 is a structural block diagram of a display panel according to embodiments of the present disclosure.

FIG. 10 is a structural block diagram of a display panel according to an embodiment of the present disclosure.

As shown in FIG. 10, the display panel 300 includes the voltage control circuit 203 of the above embodiment.

The display panel of the embodiments of the present disclosure can reduce the difference between the startup lighting time and the startup lighting brightness of each pixel by the above-mentioned voltage control circuit, improve the quality of the display image, and solve the shadowing problem caused by the different lighting characteristics of the EL materials.

Figure 11:
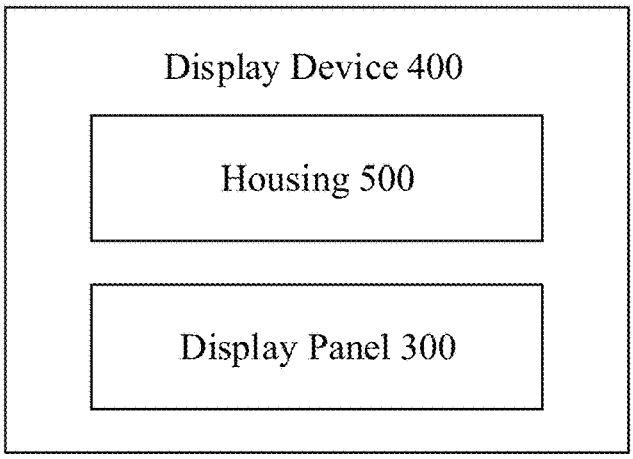
FIG. 11 is a structural block diagram of a display device according to embodiments of the present disclosure.

FIG. 11 is a structural block diagram of a display device according to an embodiment of the present disclosure.

As shown in FIG. 11, the display device 400 includes a housing 500 and the display panel 300 of the foregoing embodiments.

In the present embodiment, the display device 400 may be an LCD (Liquid Crystal Display) screen or an OLED (Organic Light-Emitting Diode) screen.

The display device of the embodiment of the present disclosure is made of the above-mentioned display panel, which can reduce the difference between the startup lighting time and the startup lighting brightness of each pixel, improve the quality of the display image, and solve the shadowing problem caused by the different lighting characteristics of the EL materials.

At least one embodiment of the present disclosure further provides a power supply voltage control method, which is used to provide power supply voltages to a display panel and can be applied to any of the above-mentioned voltage control circuits and display panels. The method includes providing the first voltage to the first pixel and the second voltage to the second pixel at the first time and the second time, respectively, in which the first voltage provided at the first time is different from the second voltage provided at the first time are different; and the first voltage provided at the second time is identical with the second voltage provided at the second time.

For example, the method further includes determining whether the display image of the current frame of the display panel is a risk image, and in response to the display image of the current frame is the risk image, the first time is within the current frame.

Figure 12:
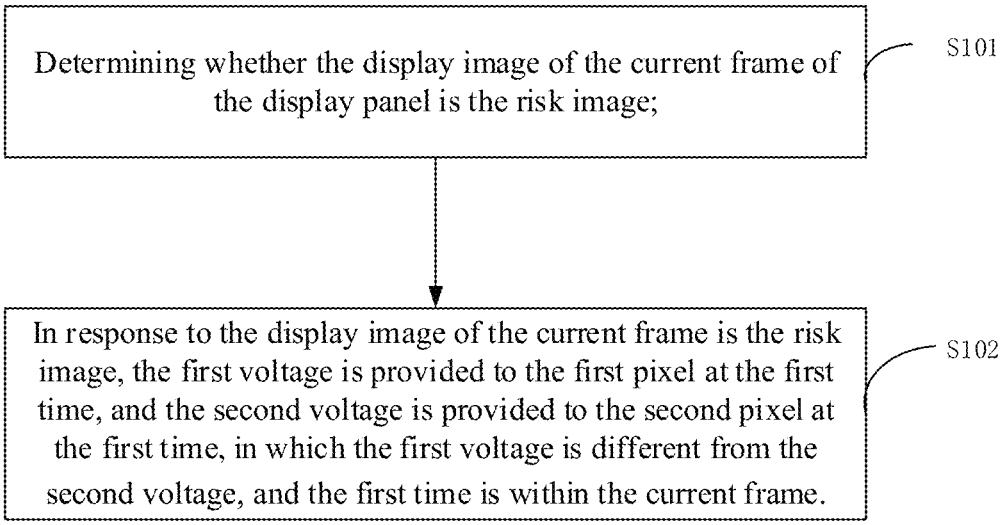
FIG. 12 is a flowchart of a power supply voltage control method according to embodiments of the present disclosure.

FIG. 12 is a flowchart of a power supply voltage control method according to at least one embodiment of the present disclosure.

As shown in FIG. 12, the method includes the following steps.

At S101, determining whether the display image of the current frame of the display panel is the risk image.

At S102, in response to the display image of the current frame is the risk image, a first voltage is provided to the first pixel at the first time, and a second voltage is provided to the second pixel at the first time, in which the first voltage is different from the second voltage, and the first time is within the current frame.

For example, a driving voltage required by each category of pixels can be determined by looking up a table.

For example, the EL materials of different pixels in the pixel array are different, and the electrical characteristics of different EL materials are also different, so the startup lighting voltage and the startup lighting time of each pixel are also different. To this end, the driving voltage of each category of pixels can be determined according to the acquired categories of each pixel, and then corresponding drive voltages can be provided to each category of pixels, respectively. Therefore, by controlling each pixel differently, the quality of the display image can be improved and the shadowing problem caused by the different startup lighting characteristics of the EL materials can be solved.

For example, the determining whether the display image of the current frame of the display panel is the risk image includes acquiring the first grayscale value of the display image of the current frame of the display panel and the second grayscale value of the display image of the previous frame of the display panel; and determining whether the display image of the current frame is the risk image according to the first grayscale value and the second grayscale value.

For example, the plurality of pixels in the display panel are divided into n display units, the determining whether the display image of the current frame is the risk image according to the first grayscale value and the second grayscale value includes calculating, for the n display units, n differences between first grayscale values of the display image of the current frame and second grayscale values of the display image of the previous frame, respectively; and in responses to a number of differences greater than the preset difference among the n differences is greater than the preset value n*k, determining the display image of the current frame as the risk image, in which $0<k\leq 1$. For example, k is greater than or equal to 75%.

It should be noted that the foregoing statements about the implementation of the voltage control circuit are also applicable to the power supply voltage control method of the embodiment of the present disclosure, and will not be repeated here.

The power supply voltage control method of the embodiments of the present disclosure can reduce the difference between the startup lighting time and the startup lighting brightness of each pixel by differently controlling each pixel, improve the quality of the display image, and solve the shadowing problem caused by the different startup lighting characteristics of the EL materials.

It should be noted that the logic and/or steps represented in the flowchart or described in other ways herein, for example, can be considered as a sequence table of executable instructions for implementing logic functions, and can be implemented in any computer readable medium for use by an instruction execution system, device, or equipment (such as a computer-based system, a system including a processor, or other systems that can obtain instructions from the instruction execution system, device, or equipment and execute the instructions), or for use by combining these instruction execution system, device or equipment. For the purposes of the present disclosure, the "computer readable medium" can be any device that can contain, store, communicate, propagate, or transmit a program for use by the instruction execution system, device, or equipment or in combination with the instruction execution system, device, or equipment. More specific examples (non-exhaustive list) of computer readable medium include the following: an electrical connection (electronic device) with one or more wirings, a portable computer disk case (magnetic device), a random-access memory (RAM), a read-only memory (ROM), a erasable and editable read-only memory (EPROM or flash memory), a fiber optic device, and a portable compact disk read-only memory (CDROM).

In addition, the computer readable medium may even be paper or other suitable media on which the program can be printed, because it can be used, for example, by optically scanning the paper or other media, and then the program is obtained in an electronical manner by editing, interpreting, or other suitable manner if necessary, and then the program is stored in the computer memory.

It should be understood that the voltage control circuit of the present disclosure can be implemented by hardware, software, firmware, or a combination thereof. In the foregoing embodiments, multiple steps or methods can be implemented by software or firmware stored in a memory and executed by a suitable instruction execution system. For example, if it is implemented by hardware, as in another embodiment, it can be implemented by any one or a combination of the following technologies known in the art: discrete logic circuits with logic gate circuits for realizing logic functions on data signals, application-specific integrated circuits with suitable combinational logic gate circuits, programmable gate array (PGA), field programmable gate array (FPGA), etc.

The above descriptions are only exemplary embodiments of the present disclosure and are not used to limit the protection scope of the present disclosure, which is determined by the appended claims.

What is claimed is:

1. A voltage control circuit, wherein the voltage control circuit is configured to be connected with a display panel, the display panel comprises a plurality of pixels, and the plurality of pixels comprise a first pixel and a second pixel, the first pixel and the second pixel are pixels corresponding to different colors, the voltage control circuit is configured to provide a first voltage to the first pixel and a second voltage to the second pixel at a first time and a second time, respectively;

the first voltage provided at the first time is different from the second voltage provided at the first time are different; and the first voltage provided at the second time is identical with the second voltage provided at the second time;

the voltage control circuit is further configured to:

determine whether a display image of a current frame of the display panel is a risk image, wherein in response to the display image of the current frame is the risk image, the first time is within the current frame;

wherein the determining whether the display image of the current frame of the display panel is the risk image comprises:

acquiring a first grayscale value of the display image of the current frame of the display panel and a second grayscale value of a display image of a previous frame of the display panel; and determining whether the display image of the current frame is the risk image according to the first grayscale value and the second grayscale value;

wherein the plurality of pixels are divided into n display units, and the voltage control circuit is further configured to:

for the n display units, calculate n differences between first grayscale value of the display image of the current frame and second grayscale value of the display image of the previous frame, respectively; and in response to a number of differences greater than a preset difference among the n differences is greater than a preset value n*k, determine the display image of the current frame as the risk image, wherein n is an integer greater than ten thousand, and $0<k\leq 1$.

2. The voltage control circuit according to claim 1, wherein k is greater than or equal to 75%.

3. The voltage control circuit according to claim 1, wherein the determining whether the display image of the current frame of the display panel is the risk image comprises:

acquiring the first grayscale value of the display image of the current frame of the display panel and the second grayscale value of the display image of the previous frame of the display panel, acquiring a brightness value of the display image of the previous frame of the display panel, and determining whether the display image of the current frame is the risk image according to the first grayscale value, the second grayscale value and the brightness value.

4. The voltage control circuit according to claim 3, wherein the plurality of pixels are divided into n display units, and the voltage control circuit is further configured to:

for the n display units, calculate n differences between first grayscale value of the display image of the current frame and second grayscale value of the display image of the previous frame, respectively; and in response to the brightness value of the display image of the previous frame is less than a preset brightness value and a number of differences greater than a preset difference among the n differences is greater than a preset value, determine the display image of the current frame as the risk image.

5. The voltage control circuit according to claim 1, wherein the plurality of pixels further comprise a third pixel, and the first pixel, the second pixel and the third pixel are pixels corresponding to different colors, respectively;

the voltage control circuit is further configured to provide a third voltage to the third pixel at the first time and the second time, respectively;

the first voltage, the second voltage, and the third voltage provided at the first time respectively are all different from each other; and the first voltage, the second voltage, and the third voltage provided at the second time respectively are all identical.

6. The voltage control circuit according to claim 5, wherein the voltage control circuit is further configured to:

in response to the display image of the current frame is the risk image, provide, at the first time, the first voltage, the second voltage, and the third voltage to the first pixel, the second pixel, and the third pixel, respectively.

7. The voltage control circuit according to claim 6, wherein the first pixel is a red pixel, the second pixel is a green pixel, and the third pixel is a blue pixel; and the first voltage provided at the first time is less than the third voltage provided at the first time, and the third voltage provided at the first time is less than the second voltage provided at the first time.

8. The voltage control circuit according to claim 7, wherein the voltage control circuit is further configured to:

in response to the display image of the current frame is the risk image, pull up the second voltage and the third voltage, and keep the first voltage unchanged.

9. A display device, comprising the voltage control circuit of claim 1 and the display panel, wherein the display panel comprises a first power supply voltage terminal and a second power supply voltage terminal, the first pixel is connected to the first power supply voltage terminal to receive the first voltage, and the second pixel is connected to the second power supply voltage terminal to receive the second voltage; and the voltage control circuit is respectively connected to the first power supply voltage terminal and the second power supply voltage terminal to provide the first voltage to the first power supply voltage terminal and provide the second voltage to the second power supply voltage terminal.

10. The display device according to claim 9, wherein the first pixel comprises a first pixel circuit and a first light emitting element connected to the first pixel circuit, the second pixel comprises a second pixel circuit and a second light emitting element connected to the second pixel circuit, and the first light emitting element and the second light emitting element are configured to emit light of different colors.

11. The display device according to claim 10, wherein the first pixel circuit and the second pixel circuit respectively comprise a driving sub-circuit, and each of the driving sub-circuit comprises a control terminal, a first terminal and a second terminal;

the first terminal of the driving sub-circuit of the first pixel circuit is configured to receive the first voltage from the first power supply voltage terminal, the second terminal of the driving sub-circuit of the first pixel circuit is connected to the first light emitting element, and the driving sub-circuit of the first pixel circuit is configured to form a driving current flowing through the first light emitting element in response to the first voltage received from the first power supply voltage terminal; and the first terminal of the driving sub-circuit of the second pixel circuit is configured to receive the second voltage from the second power supply voltage terminal, the second terminal of the driving sub-circuit of the second pixel circuit is connected to the second light emitting element, and the driving sub-circuit of the second pixel circuit is configured to form a driving current flowing through the second light emitting element in response to the second voltage received from the second power supply voltage terminal.

12. The display device according to claim 11, further comprising a first power supply line and a second power supply line, wherein the first power supply line electrically connects the first power supply voltage terminal with the first terminal of the driving sub-circuit of the first pixel circuit, and the second power supply line electrically connects the second power supply voltage terminal with the first terminal of the driving sub-circuit of the second pixel circuit; and the first power supply line is insulated from the second power supply line.

13. A power supply voltage control method for providing a power supply voltage for a display panel, wherein the display panel comprises a plurality of pixels, the plurality of pixels comprise a first pixel and a second pixel, the first pixel and the second pixel are pixels corresponding to different colors, and the method comprises:

providing a first voltage to the first pixel and a second voltage to the second pixel at a first time and a second time, respectively, wherein the first voltage provided at the first time is different from the second voltage provided at the first time, and the first voltage provided at the second time is identical with the second voltage provided at the second time; and determining whether a display image of a current frame of the display panel is a risk image, wherein in response to the display image of the current frame is the risk image, the first time is within the current frame, wherein determining whether the display image of the current frame of the display panel is the risk image comprises:

acquiring a first grayscale value of the display image of the current frame of the display panel and a second grayscale value of a display image of a previous frame of the display panel; and determining whether the display image of the current frame is the risk image according to the first grayscale value and the second grayscale value, wherein the plurality of pixels are divided into n display units, and the determining whether the display image of the current frame is the risk image according to the first grayscale value and the second grayscale value comprises:

for the n display units, calculating n differences between first grayscale value of the display image of the current frame and second grayscale value of the display image of the previous frame, respectively; and in response to a number of differences greater than a preset difference among the n differences is greater than a preset value n*k, determining the display image of the current frame as the risk image, wherein n is an integer greater than ten thousand, and $0<k\leq 1$.

14. The method according to claim 13, wherein k is greater than or equal to 75%.

* * * * *